US008813392B2

(12) United States Patent
Maron et al.

(10) Patent No.: US 8,813,392 B2
(45) Date of Patent: Aug. 26, 2014

(54) KINEMATIC SHOE SOLE AND SHOE HAVING KINEMATIC SHOE SOLE

(75) Inventors: Urs Maron, Ipsach (CH); David Macher, Voitsberg (AT)

(73) Assignee: Swiss Line Fashion AG, Nidau (CH)

( * ) Notice: Subject to any disclaimer, the term of this patent is extended or adjusted under 35 U.S.C. 154(b) by 798 days.

(21) Appl. No.: 12/977,112

(22) Filed: Dec. 23, 2010

(65) Prior Publication Data

US 2011/0252671 A1 Oct. 20, 2011

(30) Foreign Application Priority Data

Jan. 19, 2010 (EP) ..... 10000488

(51) Int. Cl.

| | |
|---|---|
| ***A43B 13/14*** | (2006.01) |
| ***A43B 13/16*** | (2006.01) |
| ***A43B 13/12*** | (2006.01) |
| ***A43B 3/00*** | (2006.01) |

(52) U.S. Cl.

CPC ..... *A43B 13/141* (2013.01); *A43B 13/16* (2013.01); *A43B 13/12* (2013.01); *A43B 3/0057* (2013.01)

USPC ..... 36/102; 36/25 R; 36/31

(58) Field of Classification Search

USPC ..... 36/102, 25 R, 31, 32 R, 28

See application file for complete search history.

(56) References Cited

U.S. PATENT DOCUMENTS

| | | | | |
|---|---|---|---|---|
| 6,115,945 | A * | 9/2000 | Ellis, III | 36/102 |
| 7,124,519 | B2 * | 10/2006 | Issler | 36/31 |
| 7,290,357 | B2 * | 11/2007 | McDonald et al. | 36/102 |
| 2005/0150134 | A1 | 7/2005 | Issler | |

FOREIGN PATENT DOCUMENTS

| | | | |
|---|---|---|---|
| WO | 2006124116 | A2 | 11/2006 |
| WO | WO 2006/124116 | A2 | 11/2006 |

* cited by examiner

*Primary Examiner* — Ted Kavanaugh
(74) *Attorney, Agent, or Firm* — Marshall & Melhorn, LLC

(57) ABSTRACT

The invention relates to a shoe sole having kinematic properties on the basis of conventional materials (leather, rubber, EVA) or any desired combination of these materials in a single-layer or multilayer structure which do not block, but rather promote the natural rolling characteristics of the foot. In accordance with the invention, a shoe is equally proposed having a shoe sole of this type.

21 Claims, 2 Drawing Sheets

KINEMATIC SHOE SOLE AND SHOE HAVING KINEMATIC SHOE SOLE

FIELD OF THE INVENTION

The invention relates to a shoe sole having kinematic properties on the basis of conventional materials (leather, rubber, EVA) or any desired combination of these materials in a single-layer or multilayer structure which do not block, but rather promote the natural rolling characteristics of the foot. In accordance with the invention, a shoe is equally proposed having a shoe sole of this type.

BACKGROUND OF THE INVENTION

It is known that conventional soles typically have a structure in the following designs:

A)

a two-layer structure based on an outsole and an insole. (Leather, rubber, other materials)

B)

a multilayer structure comprising an outsole, midsole(s) and an insole, in which different materials such as leather, reclaimed leather, synthetic fiber fabrics, thermoplastics, especially impregnated board, EVA, rubber are used and are adhesively bonded or pressed together.

The bending stiffness of the sole in these embodiments can only be changed in the longitudinal direction by use of different materials or material combinations (harder, softer), but this does not allow any influencing of the vertical/diagonal flexibility which is decisive for the natural rolling characteristics of the foot.

Conventional soles thus comprise multilayer leather sheet materials which are adhesively bonded in a sandwich, i.e. the bending stiffness of the sole can admittedly be made softer or harder in the longitudinal direction of the different layers, but the vertical bending stiffness of such shoe soles cannot be influenced.

BRIEF SUMMARY OF THE INVENTION

Starting from this, it is the underlying object of the invention to provide a sole which avoids these disadvantages of the usual multilayer structure and which enables the flexibility in the vertical/diagonal axis required for the natural rolling characteristics.

In accordance with the invention, a kinematic shoe sole having a segmented structure is provided which is formed from at least one material layer which has a lateral joint as well as at least one medial joint which divide the sole into the individual segments, with the lateral and/or the medial joint passing partly or fully as a throughgoing groove through the material layer, which joint or joints may not be filled with a flexible material or which may be partly or fully filled with a flexible material, with the lateral joint having at least one cut-out which is partly or fully filled with a material having an equally large and/or smaller Shore hardness, measured in accordance with DIN 53505, compared with the materials of the segments.

In accordance with the invention, a joint is understood as a region of the sole at which the sole either has a cut-out in the material layer, i.e. a region at which the corresponding material layer of the shoe sole is interrupted, but equally includes the possibility that the material layer of the shoe sole is formed thinner in the region of the joint so that the joint represents a groove-like recess in the respective material layer. The possibility is furthermore included that the joint may be designed so that the material layer at the joint is admittedly precisely as thick as in the other region of the shoe sole, but the material represents a material in the region of, the joint which represents a higher flexibility compared with the remaining material of the material layer of the shoe sole, i.e. the above-mentioned groove is fully filled with a flexible material. It is decisive in this respect that the flexibility of the sole is higher in the region of the joints than in the region of the horizontal segments which are mutually bounded by the joints.

A "lateral" joint is to be understood as a joint which extends substantially in the longitudinal direction of the sole, i.e. substantially from the region of the tips of the toes up to the heel region, with the course of the lateral joint not necessarily having to be formed as a throughgoing line, but rather also being able to have branches or kinks. It is, however, essential for the "lateral" course of the joint that the course of the joint always has a vectorial direction component in the longitudinal direction of the foot.

In contrast to this, a "medial" joint represents a joint which branches off from the lateral joint, i.e. adopts a different course than the lateral joint. The medial joint(s) in this respect extend(s) in the transverse direction of the foot, i.e. directions which extend substantially perpendicular to the longitudinal direction of the foot as defined above.

It is now material to the invention that at least one cut-out is applied in the course of the lateral joint, said cut-out being filled fully or partly with a material having a specific Shore hardness, with the filler material of the cut-out being able to have different Shore hardnesses, but also the same Shore hardness, in comparison with the materials of the other segments of the material layer of the sole depending on the application. The cut-out in this respect is formed like the individual joints, i.e. as a groove-like recess or opening introduced into the material layer.

A kinematic chain which substantially improves the flexibility of the sole along the joints is formed by such an arrangement of the lateral filled cut-out, at least of a medial filled cut-out and of a filled cut-out applied in the lateral joint. A natural rolling movement is hereby made possible and barefoot walking is simulated, whereby the wearing comfort of a shoe equipped with a shoe sole in accordance with the invention is considerably increased. Additional "pressure points" are formed by the cut-outs filled with the flexible material and subsequently support the arch of the foot during walking so that an ergonomic shoe sole adapted to the anatomy of the foot results overall.

In a preferred first embodiment, the sole has three mutually adjacent regions, namely a) a toe region in which the lateral joint extends substantially parallel to the toes;

b) a midfoot region in which the lateral joint has a non-linear course; and c) a tarsal region in which the lateral joint extends substantially parallel to the direction of the foot, wherein the lateral joint is formed in throughgoing manner over all the previously named regions.

In such an embodiment, the lateral joint is thus so-to-say formed over the total length of the sole. Such an embodiment is above all used with shoe soles for shoes without heels or with flat heels (<2 cm), with the lateral and/or the medial joint also being able to be a component of the heel. A shoe sole formed in this manner can equally be used as an inlay sole for shoes with higher heels (>2 cm), e.g. ladies' shoes with higher heels.

In an alternative preferred second embodiment, the sole has three mutually adjacent regions, namely a) a toe region in which the lateral joint extends substantially parallel to the toes;

b) a midfoot region in which the lateral joint has a non-linear course;

c) a tarsal region in which no lateral or medial joint is formed, wherein the lateral joint is formed in throughgoing manner over the two first-named regions.

In such an embodiment, no lateral or medial joint is thus formed in the tarsal region. A shoe sole formed in this manner is in particular suitable for shoes having higher heels, in particular as a midsole or as an outsole.

The definition of the above-mentioned regions, of the toe region, the midfoot region and the tarsal region, is in this respect based on the anatomical definition of the corresponding regions of the foot.

The foot (pes) can be divided into the tarsus (ossa tarsi, tarsus) comprising talus calcaneus scapiphoid bone cuboid bone splenoid bones the midfoot (ossa metatarsi, metatarsus)

metatarsal bone and the toes (digiti pedis)

toe bones.

In accordance with the definition, a "toe region" of the shoe sole is thus understood as that region in which the toe bones of the foot come to lie when a wearer wears the shoe having the shoe sole arranged thereat. The same applies accordingly to the midfoot region or to the tarsal region of the shoe sole; they in each case represent the regions in which the metatarsal bones or the tarsal bones of the foot come to lie.

In accordance with the above-explained first preferred embodiment, a lateral joint is thus provided in the shoe sole which extends over all three previously named regions of the shoe sole, with the lateral joint merging seamlessly into the individual regions and thus continuing through the shoe sole. The lateral joint can be formed at the two marginal regions, at the toe region and at the tarsal region so that it extends up to its margins so that the joint is then formed over the complete length of the shoe sole; it is, however, equally possible that the lateral joint does not extend up to and into the margins of the shoe sole in the two last regions and thus already ends before the margin of the shoe sole so that a certain region of the segments is mutually connected in throughgoing manner. The same applies accordingly to the second preferred embodiment, with the provision that no joints are present in the tarsal region here.

It is furthermore preferred if the lateral joint is arranged substantially in the region of the second toe in the toe region. In this preferred embodiment, the lateral joint formed in the toe region is therefore formed at the position at which the second toe, that is, the toe adjacent to the big toe, is normally located when wearing the shoe. In this respect, the lateral joint in particular extends parallel to the second toe in the toe region, i.e. substantially parallel to the toe bones of the second toe (ossa digiti pedes II).

Alternatively or additionally to this, it can be preferred that the lateral joint first has a substantially parallel extent to the second metatarsal bone (os metatarsale II) in the direction of the toe region toward the tarsal region, subsequently has a first kink, after which the lateral joint adopts a non-parallel extent to the metatarsal bone in the direction of the further outwardly lying metatarsal bone, and subsequently has a second kink, after which the lateral joint substantially again adopts the course of direction it has in the toe region.

This preferred embodiment provides that the course of the lateral joint in the midfoot region first provides a continuation of the course of direction as in the toe region, i.e. the joint first continues to extend, starting at the border of the toe region to the midfoot region, as in the toe region, i.e. substantially parallel to the bones of the midfoot of the second toe (os metatarsale II) when the foot is arranged over the sole. Subsequently, the lateral joint extends in kinked form in the midfoot region, with a first kink change having the result that the course of the lateral sole leads to the further outwardly lying regions of the foot, i.e. to the metatarsal bone of the third, fourth or fifth toes. It is, however, decisive here that a certain vectorial direction component of the course of the lateral joint is still present as was present in the toe region (that is in the longitudinal direction of the sole or of the foot), i.e. no completely right-angled angling of the joint takes place in comparison with the course of the joint in the toe region. The joint now therefore does not extend parallel to the metatarsal bones and continues into the outer foot region. After a certain extent in the outward direction, a second kink of the joint takes place, after which the extent of the joint in the further midfoot region (this is the part of the midfoot region which is adjacent to the tarsal region) again extends substantially as in the toe region. This second kink can, for example, be arranged in projection of the foot onto the sole at the transition border of the tarsal bones to the metatarsal bones of the third or fourth toes.

In the further extent, i.e. in the tarsal region, the lateral sole then extends further preferably substantially centrally to the sole. As already indicated in the above, the direction of extent is here again substantially parallel to the direction which is also present in the toe region. Specific deviations of the extent of the lateral joint after the second kind in the midfoot region or in the tarsal region are, however, possible, for example a deviation of the direction of extent of the lateral joint from the second kink onward up to and into the metatarsal region is possible by, for example, ±0° to 15° with respect to the direction of the joint, as is present in the toe region.

It is in this respect equally preferred that the joint adopts a straight-line extent from the second kink in the midfoot region onward up to the end of the joint in the tarsal region, i.e. no further kinks are present here.

In a further preferred embodiment, at least one medial joint branches off from the lateral joint at the level of the first kink, said lateral joint preferably extending in the direction of the first metatarsal bone (os metatarsale I).

The previously described medial joint in this respect preferably has a direction which extends substantially at right angles (here a deviation of ±0° to 20° is also possible) to the direction of the lateral joint in the toe region. The preferred direction into which the medial joint branches here is in this respect the direction of the big toe. It is, however, equally possible that e.g. in addition yet a further medial joint branches off from the first kink which then extends in the opposite direction, i.e. in the direction of the outer toes.

It is furthermore preferred if at least one medial joint branches off from the lateral joint at the level of the second kink which preferably extends in the direction of the outer side of the foot. The statements which were already made on the medial joint which branches off at the level of the first kink apply equally with respect to the medial joint which branches off at the level of the second kink. The medial joint which branches off at the level of the second kink preferably extends in the outer direction of the foot, i.e. in the direction of the outwardly disposed toe bones, i.e. fourth or fifth toes. In addition, however, a further medial joint is conceivable here which branches off from the second kink in the inner direction of the foot, i.e. in the direction of the first toe.

It is furthermore advantageous if at least one, preferably two medial joints branch off from the lateral joint, and extend toward the inner side and/or outer side of the foot, in the tarsal region at the level of the calcaneus, preferably at the level of the region forming the contact point of the calcaneus.

In the event that a medial joint is arranged in this region, it can extend in the inner direction of the foot or, in the outer direction of the foot, whereas for the case that two medial joints are arranged here, they extend in the direction of the inner foot and of the outer foot. The statements already also made above also apply with respect to the angles at which the medial joints branch off.

It is equally possible that a plurality of the joints described in the previously named regions are present in the shoe sole.

It is further preferred if the shoe sole has at least two, preferably three, in particular at least four cut-outs which are preferably circular. These cut-outs are in this respect each arranged in the region, i.e. at the level of or in the extent of the lateral joint, and are filled with a more or less flexible material (in comparison with the materials from which the segments are formed).

In a particularly preferred embodiment, the lateral joint of the shoe sole has four filled cut-outs, wherein a) the first filled cut-out is arranged in the toe region or at the level of the border between the toe region and the midfoot region;
b) the second filled cut-out is arranged at the level of the first kink;
c) the third filled cut-out is arranged at the level of the second kink; and/or
d) the fourth cut-out is arranged in the tarsal region, preferably at the level of the contact point of the calcaneus.

Exact arrangement points for the filled cut-outs are preset via this definition.

The foot has 3 contact points:

1. calcaneus
2. head of the first metatarsal bone; and
3. head of the fifth metatarsal bone, which are connected by two longitudinal arches and one transverse arch.

In this preferred embodiment, as described above, the two middle cut-outs (the second and the third cut-outs) thus serve the support of the transverse arch of the foot and thus result in the relief of the two contact points at the head of the first metatarsal bone and at the head of the fifth metatarsal bone. In this respect, the arch of the foot is substantially relieved by the corresponding arrangement of the filled cut-outs during the rolling procedure of the shoe and a feeling of walking barefoot arises. It is preferred in this respect if the material of the fillings of the cut-outs has a somewhat higher hardness than the material of the segments so that an efficient pressure transfer is possible.

It is thus possible with respect to the above-given definitions both with regard to the course of the respective joints and to the position of the cut-outs with reference to the corresponding anatomical details of the foot to carry out a made-to-measure production of a respective shoe sole in accordance with the invention for a wearer. On the other hand, it is also possible to start from a standardized foot model and thus to carry out a mass production of the shoe soles.

The length of the lateral joint and/or of the at least one medial joint can in this respect be formed over the total length or total width of the sole and/or only over a part of the sole. This means that the lateral and/or medial joints can be guided up to the respective margin of the shoe sole, while likewise the possibility is given that the joints already end before the margin of the shoe sole.

It is, however, equally possible that the previously named joints, i.e. the lateral and/or the medial joints are not directly adjacent to the cut-outs, but that rather a small intermediate piece is inserted between the cut-out and the respective joint and comprises the material from which the segments of the shoe sole are formed. In other words, the possibility is covered that the respective joints lead directly up to the cut-outs and, so-to-say, merge with them, while the possibility is equally given that the joints stop before they arrive at the cut-outs and the last intermediate piece between the joint and the cut-outs is formed from the respective materials of the shoe sole segments.

With respect to the materials from which the shoe sole can be formed, in particular the following materials can be considered for the segments: leather, reclaimed leather, synthetic fiber fabrics, thermoplastics, thermoplastic elastomers on an olefin base (TPO), vulcanized thermoplastic elastomers on an olefin base (TPV), thermoplastic elastomers on a urethane base (TPU), thermoplastic copolyesters (TPC), styrene block copolymers (TPS), in particular SBS, SEBS, SEPS, SEEPS and/or MBS, thermoplastic copolyamides (TPA), thermoplastic rubbers (TPR), glass-fiber reinforced plastics (GFK), carbon fiber reinforced plastics (CFK), elastomers, impregnated board, natural latex, rubber, ethylene vinyl acetate (EVA), polyurethane (PU), PTFE membrane materials and/or combinations thereof.

The following materials can be used for the filler materials of the lateral joint and/or of the medial joint: synthetic fiber fabrics, thermoplastics, thermoplastic elastomers on an olefin base (TPO), vulcanized thermoplastic elastomers on an olefin base (TPV), thermoplastic elastomers on a urethane base (TPU), thermoplastic copolyesters (TPC), styrene block copolymers (TPS), in particular SBS, SEBS, SEPS, SEEPS and/or MBS, thermoplastic copolyamides (TPA), thermoplastic rubbers (TPR), glass fiber reinforced plastics (GFK), carbon fiber reinforced plastics (CFK), elastomers, natural latex, rubber, ethylene vinyl acetate (EVA), polyurethane (PU) and/or combinations thereof Preferred materials which may be considered for the filling of the cut-out are in this respect selected from the group comprising synthetic fiber fabrics, thermoplastics, thermoplastic elastomers on an olefin base (TPO), vulcanized thermoplastic elastomers on an olefin base (TPV), thermoplastic elastomers on a urethane base (TPU), thermoplastic copolyesters (TPC), styrene block copolymers (TPS), in particular SBS, SEBS, SEPS, SEEPS and/or MBS, thermoplastic copolyamides (TPA), thermoplastic rubbers (TPR), glass-fiber reinforced plastics (GFK), carbon fiber reinforced plastics (CFK), elastomers, natural latex, rubber, ethylene vinyl acetate (EVA), polyurethane (PU) and/or combinations thereof It is further possible that a) all segments comprise materials of the same Shore hardness, in particular the same materials;
b) the segments comprise materials of different Shore hardness; and/or
c) the material of at least one segment has a graduated course of Shore hardness.

These embodiments of the shoe sole provide that, for example, all the segments of the shoe sole have the same Shore hardness and thus a so-to-say uniform shoe sole is provided. It is, however, equally possible to design specific segments harder than other segments so that, for example, the wear behavior of the shoe sole can be set directly on longer wear. It is furthermore possible that individual segments can have a specific course of Shore hardness, i.e. can be designed harder at some regions than at other regions of the same segment. This embodiment can also be used in combination with the previously named embodiments with respect to Shore hardness.

The shoe sole in accordance with the invention can, for example, be configured as a segmented outsole (this is the outermost material layer of the sole with which the shoe is in contact with the ground), as a segmented insole, as a segmented midsole (this is the sole which is arranged at the interior of the shoe) or as an inlay sole.

A further alternative of the invention relates to an embodiment in which the segmented outsole additionally has a heel in the tarsal region (III). Such outsoles having a heel are in particular known from the field of men's shoes. In accordance with the invention, a damper is now integrated in the heel of the outsole, with the outsole having a structure such as described above. It is important in this respect that the damper is produced from a material or includes a material whose Shore hardness is larger than the Shore hardness of the remaining material of the outsole. In this respect, generally all materials such as have been described for the materials for the segments of soles previously described in accordance with the invention can be considered as materials for the damper. It is in this respect preferred if the damper in the heel comprises ethylene vinyl acetate (EVA) and/or thermoplastic elastomers on a urethane base (TPU) or includes such materials. The Shore hardness of the damper in this respect preferably amounts to >40, particularly preferably >45, whereas the Shore hardness of the materials of the further outsole lies in the range of 40.

A further variant of the invention relates to an embodiment in which either the segmented midsole and/or also the segmented insole is configured so that it has a varying Shore hardness starting from the toe region over the midfoot region up to the tarsal region. It is important in this respect that the Shore hardness is larger in the midfoot region than in the toe region and tarsal region. This can be achieved in that the insole or the midsole are made from corresponding materials so that the material used for the midfoot region is selected so that it has a higher Shore hardness than in the tarsal region and in the toe region. The transition of the Shore hardness from the toe region over the midfoot region to the tarsal region can in this respect also take place continuously. In this respect, the materials already described above for the outsole can be considered as materials. The Shore hardness is in this respect preferably >40, particularly preferably >45, in the midfoot region, whereas is it in the region of 40 in the tarsal region and in the toe region.

It is, however, decisive in these embodiments, as described above, that the Shore hardness is in any case larger in the midfoot region for the insole and the midsole respectively. The specific values for the Shore hardness ultimately also depend on the selection of the material. This also applies to the formation of the above-described outsole having the heel.

In accordance with the invention, the shoe sole can be configured as a single-layer shoe sole; however, it is equally possible that the shoe sole a) is formed with two layers and has an outsole as well as in insole or inlayer sole arranged above it; or
b) is formed with multiple layers and has an outsole, at least one midsole arranged above it as well as an insole and/or inlay sole arranged above it, wherein at least one of the layers is configured as a shoe sole in accordance with one of the preceding claims.

It is advantageous with a multilayer embodiment of the shoe sole (i.e. the shoe sole includes two, three or more layers) that in each case the lateral joint, the at least one medial joint and/or the at least one filled cut-out a) are arranged congruently or non-congruently; and/or
b) the at least two layers have the same or different dimensions, preferably the same or different lengths and/or widths of the lateral joint and/or at least one medial joint or diameters of the at least one filled cut-out.

In accordance with the invention, a shoe is equally provided which includes a shoe sole in accordance with the invention.

The invention will be explained in more detail with reference to the following statements and to the enclosed Figures without restricting the invention to the specific embodiments set forth there.

In accordance with the invention, conventional sole materials are divided by lateral and medial rolling joints into zones having different properties.

Circular free spaces (cut-outs) are provided at the intersections of the lateral and medial joints; they are filled with flexible materials of different Shore hardnesses and act as hinges between the rigid and flexible sole parts (kinetic points).

The lateral and medial joints are filled with flexible materials, with the Shore hardness of these materials being able to be adapted to the properties of the sole.

The zones/areas of conventional sole material arising by the lateral and medial rolling joints take over the stabilization function due to their higher Shore hardness.

DETAILED DESCRIPTION OF THE INVENTION

Figure 1:
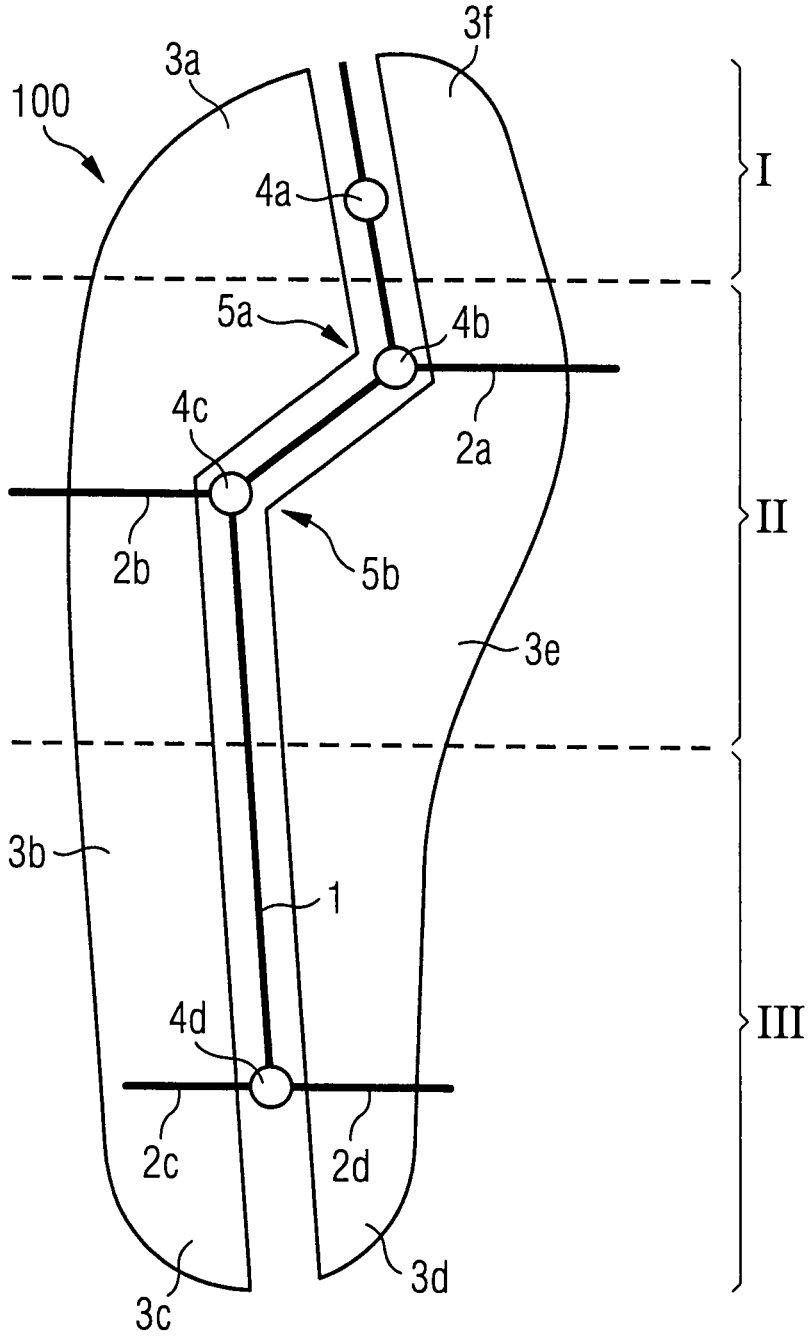
FIG. 1 depicts an exemplary shoe sole in accordance with the invention.

An exemplary shoe sole in accordance with the invention is shown in FIG. 1. The sole shown here shows a perspective representation of a sole of a left shoe from above. A corresponding mirror formation produces the sole of the right foot. The shoe sole 100 shown there has a lateral joint 1 which is formed in a throughgoing manner through the shoe sole 100 and which extends from the tip of the foot up to the heel. In this respect, the shoe sole has three regions, a toe region 1, a midfoot region II as well as a tarsal region III which represents the corresponding anatomical positions of the foot. The course of the lateral joint 1 in the toe region I is in this respect substantially parallel to the second toe, i.e. the lateral joint 1 is here arranged at the level of the second toe. In the midfoot region II, the lateral joint initially has a course coming from the toe region I which represents a continuation of the course in the toe region I. Subsequently, the lateral joint 1 has a first kink 5*a* at which it adopts a course directed to the further outwardly disposed metatarsal bone until a second kink 5*b* directs the course of the lateral joint 1 back in the original direction (i.e. substantially the direction the joint has in the toe region I) and continues in the direction of the heel. In the tarsal region III, the lateral joint 1 extends approximately at the center of the sole 100.

In the example of the shoe sole 100 in accordance with the invention shown in FIG. 1, a first medial joint 2*a* starts off at the level of the kink 5*a*, a second medial joint 2*b* starts off at the level of the kink 5*b* and third and fourth medial joints 2*c* and 2*d* start off at the level of the calcaneus. The first medial joint 2*a* in this respect leads to the inside of the foot, i.e. in the direction of the big toe starting from the first kink 5*a*. The situation is exactly the opposite with the second medial joint 2*b* which is arranged at the level of the second kink 5*b*; the second medial joint 2*b* is guided in the direction of the outside of the foot, i.e. in the direction of the further outwardly disposed toes. The two further medial joints 2*c* and 2*d* are in this respect preferably arranged at the level of the calcaneus and flank the contact point of the foot preset by the calcaneus.

Flexibility points in the shoe sole are now preset by the lateral joint 1 as well as by the medial joints 2 and ensure an improved movability and suppleness of the shoe sole 100 on rolling.

In this respect, the shoe sole 100 is divided by the joints 2*a* to 2*d* into segments 3*a* to 3*f* which have a free movability or flexibility or suppleness with respect to one another due to the joints which are formed more or less in a throughgoing manner through the shoe sole 100 and thus equally contribute to an improved rolling and to a feeling of walking barefoot.

Furthermore, the shoe sole 100 has different "pressure points" which are formed as cut-outs 4*a* to 4*d*, with the cut-outs each being filled with a material of a specific Shore hardness which can, for example, be higher than the material of the segments 3*a* to 3*f*. In this respect, the first pressure point 4*a* (i.e. the cut-out 4*a* with corresponding filling) is arranged in the toe region; equally, this pressure point can be arranged at the boundary between toe region I and midfoot region II at the level of the lateral joint 1. The second pressure point 4*b* is in this respect preferably formed precisely at the first kink 5*a*, while the third pressure point 4*c* is formed at the second kink 5*b*. The further pressure point 4*d* in this respect preferably represents the point which represents the contact point of the foot disposed at the rear, i.e. the region at which the calcaneus bone is arranged. In this respect, the transverse arching of the foot can be considerably supported by the pressure points 4*b* and 4*c* so that the two contact points of the foot disposed at the front can be relieved.

Figure 2:
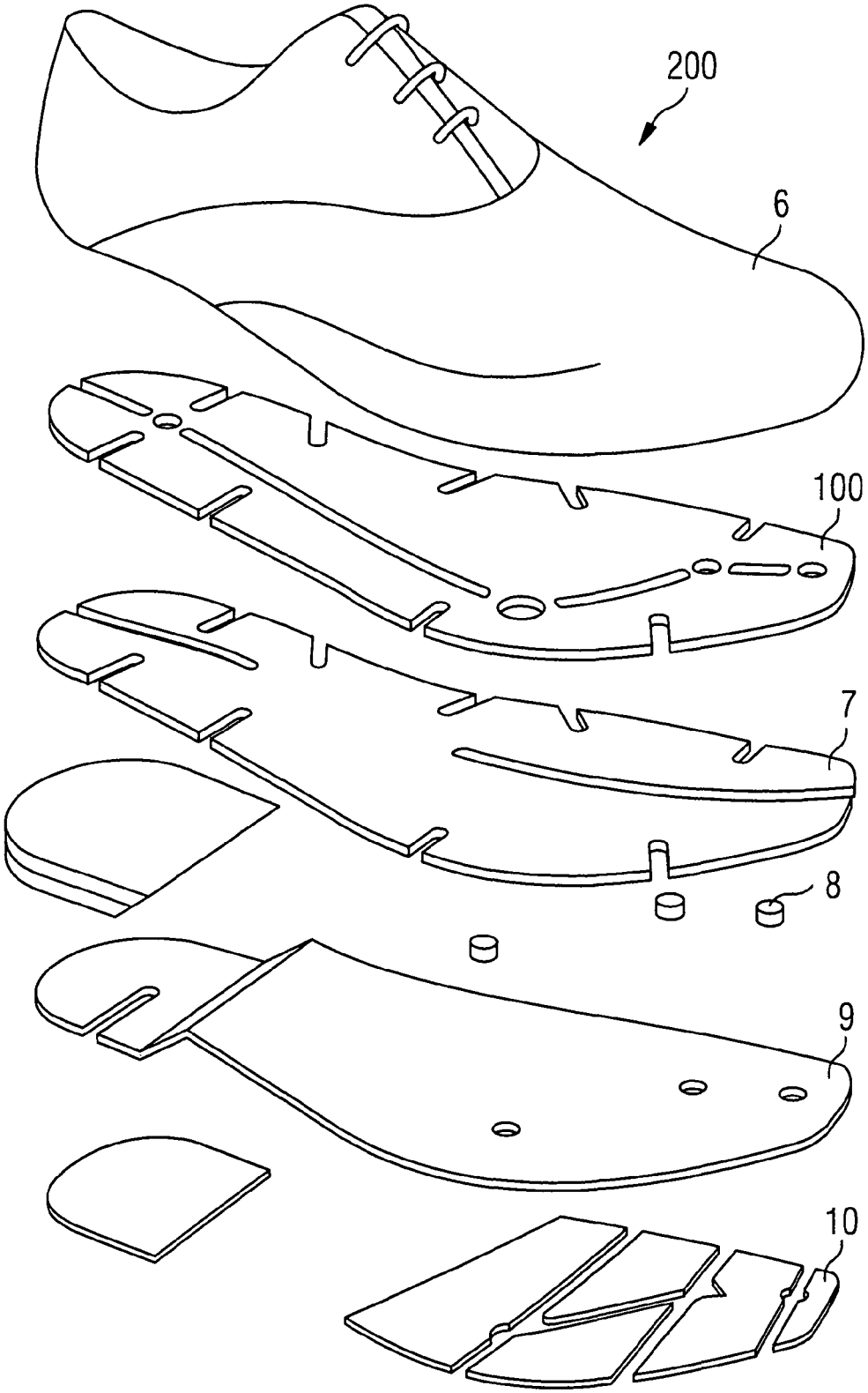
FIG. 2 depicts an exploded drawing of a shoe in accordance with the invention.

FIG. 2 represents an exploded drawing of a shoe 200 in accordance with the invention which in the example of FIG. 2 has an upper 6 made of leather. In the example of FIG. 2, the sole 100 in accordance with the invention is directly formed as the inlay sole, i.e. the innermost sole of the shoe 200. A midsole 7 adjoins it afterward and can equally have pressure points 8, with the pressure points 8 also being able to be formed in a throughgoing manner to the sole 100 in accordance with the invention. Subsequent thereto, there is an outsole 9 which can furthermore be complemented by a tread 10.

By Combination of multiple layers;

having different arrangements of the medial and lateral rolling joints;

having different materials for the rolling joints and kinetic points, the properties can be individually adapted to the application or to the type of shoe.

Typical embodiments by way of example are:

A) Two-Layer Sole Structure

The kinetic chain (properties of the sole) is defined by:

The material of the outsole, e.g. rubber.

The arrangement, width and length of the lateral and medial rolling joints in the outsole.

The material (Shore hardness) of the rolling joints in the outsole

The arrangement and dimensions of the kinetic points in the outsole.

The material of the kinetic points (Shore hardness) in the outsole.

The insole (inner sole).

B) Two-Layer Sole Structure

The kinetic chain (properties of the sole) is defined by:

Outsole:

The material of the outsole, e.g. rubber.

The arrangement, width and length of the lateral and medial rolling joints in the outsole.

The material (Shore hardness) of the rolling joints in the outsole.

The arrangement and dimensions of the kinetic points in the outsole.

The material of the kinetic points (Shore hardness) in the outsole.

Insole:

The material of the insole (inner sole), leather, plastics, etc.

The arrangement, width and length of the lateral and medial rolling joints in the insole (inner sole)

The material (Shore hardness) of the rolling joints in the insole (inner sole).

The arrangement and dimensions of the kinetic points in the insole (inner sole).

The material of the kinetic points (Shore hardness) in the insole (inner sole).

C) Multilayer Sole Structure Having Midsoles

The kinetic chain (properties of the sole) is defined by:

All the layers of the shoes are manufactured in the same material. (leather, rubber, . . . )

The arrangement, width and length of the lateral and medial rolling joints is identically configured in all layers.

The material (Shore hardness) of the rolling joints is identically configured in all layers.

The arrangement and dimensions of the kinetic points is identically configured in all layers.

The material of the kinetic points (Shore hardness) is identically configured in all layers.

D) Multilayer Sole Structure Having Intermediate Layers

The kinetic chain (properties of the sole) is defined by:

The layers of the sole are manufactured in different materials having different properties.

The arrangement of the lateral and medial rolling joints in the individual layers is configured differently with respect to one another.

The length and width of the lateral and medial rolling joints in the individual layers is differently configured.

Different materials (Shore hardness) for the rolling joints are used in the individual layers.

The arrangement of the kinetic points in the individual layers is not identically configured with respect to one another.

The material of the kinetic points (Shore hardness) is differently configured in all layers.

The dimensions of the kinetic points are differently configured in all layers.

Process steps for manufacturing a sole in accordance with the invention by way of example at a layer, e.g. outsole, of leather:

Stamping the leather sole

Introducing the lateral joints, of the medial joints and of the circular free positions for the kinetic points by stamping.

Preparing the kinetic elements in an injection molding process or stamping process.

Inlaying the leather sole and the kinetic elements into the injection mold

Filling the rolling joints with flexible material in an injection molding process.

There arises in this respect:

A) A flexible connection between
the leather sole;
the kinetic elements; and
the flexible plastic in the rolling joints.

B) A partial flexible cover layer at the
lower side of the leather sole (seal,
wear layer, damping).
Furthermore, a throughgoing cover layer can also be realized at the upper side of the leather sole.

With a multilayer structure, these process steps are repeated for each individual layer; the layers are adhesively bonded/pressed in a standard process. The connection of the finished sole to the shaft of the shoe can take place using methods usual in the shoe industry (adhesive bonding/adhesively pinched), sewed on, injected on.

The invention claimed is:

1. A kinematic shoe sole having a lateral joint as well as at least one medial joint which divide the sole into at least two segmented structures, wherein the at least two segmented structures comprise materials of different Shore hardness, wherein the lateral and/or the medial joint is formed as a groove in a partly or fully throughgoing manner through the shoe sole, said groove being filled partly and/or fully with a flexible material, the lateral joint has at least one cut-out which is partly or fully filled with a material having an equal and/or a smaller Shore hardness in comparison with the material of at least one of the at least two segmented structures.

2. A shoe sole in accordance with claim 1, characterized in that the sole has three mutually adjacent regions, a) a toe region in which the lateral joint extends substantially parallel to the toes;
b) a midfoot region in which the lateral joint has a non-linear course; and
c) a tarsal region in which the lateral joints extend substantially parallel to the foot direction, wherein the lateral joint is formed in a throughgoing manner over the regions.

3. A shoe sole in accordance with claim 1, characterized in that the sole has three mutually adjacent regions, a) a toe region in which the lateral joint extends substantially parallel to the toes;
b) a midfoot region in which the lateral joint has a non-linear course; and
c) a tarsal region in which no lateral and medial joints are formed, wherein the lateral joint is formed in a throughgoing manner over the regions.

4. A shoe sole in accordance with one of claims 2-3, characterized in that the lateral joint a) is arranged substantially in the region of a second toe in the toe region; and/or
b) in the midfoot region, in the direction from the toe region to the tarsal region,
first has a substantially parallel course to a second metatarsal bone;
subsequently has a first kink, wherein the lateral joint adopts a non-parallel course to the second metatarsal bone in the direction of the further outwardly disposed second metatarsal bone; and
subsequently has a second kink, wherein the lateral joint substantially adopts that course of direction which it has in the toe region; and/or
c) substantially extends in the center of the sole in the tarsal region.

5. A shoe sole in accordance with claim 4, comprising at least one of:

a) at least one medial joint branches off from the lateral joint at the level of the first kink;
b) at least one medial joint branches off from the lateral joint at the level of the second kink foot; and
c) at least one medial joint branches off from the lateral joint in the tarsal region at the level of a calcaneus bone, said at least one medial joint extending toward the inside and/or outside of the foot.

6. A shoe sole in accordance with claim 5, characterized in that it has at least two cut-outs.

7. A shoe sole in accordance with claim 5, characterized in that it has at least three cut-outs.

8. A shoe sole in accordance with claim 5, characterized in that it has at least four cut-outs.

9. A shoe sole in accordance with claim 8, characterized in that the lateral joint has four filled cut-outs, wherein a) the first filled cut-out is arranged in the toe region and/or at the level of the border between the toe region and the midfoot region;
b) the second filled cut-out is arranged at the level of the first kink;
c) the third filled cut-out is arranged at the level of the second kink; and/or
d) the fourth cut-out is arranged in the tarsal region.

10. A shoe sole in accordance with claim 9, characterized in that the lateral joint and/or the at least one medial joint are formed over the total length or total width of the sole and/or only over a part of the sole.

11. A shoe sole in accordance with claim 10, characterized in that a) the material of the segments is selected from the group comprising leather, reclaimed leather, synthetic fiber fabrics, thermoplastics, thermoplastic elastomers on an olefin base (TPO), vulcanized thermoplastic elastomers on an olefin base (TPV), thermoplastic elastomers on a urethane base (TPU), thermoplastic copolyesters (TPC), styrene block copolymers (TPS), in particular SBS, SEBS, SEPS, SEEPS and/or MBS, thermoplastic copolyamides (TPA), thermoplastic rubbers (TPR), glass-fiber reinforced plastics (GFK), carbon fiber reinforced plastics (CFK), elastomers, impregnated board, natural latex, rubber, ethylene vinyl acetate (EVA), polyurethane (PU), PTFE membrane materials and/or combinations thereof;
b) the filling material of the lateral joint and/or the medial joint is selected from the group comprising synthetic fiber fabrics, thermoplastics, thermoplastic elastomers on an olefin base (TPO), vulcanized thermoplastic elastomers on an olefin base (TPV), thermoplastic elastomers on a urethane base (TPU), thermoplastic copolyesters (TPC), styrene block copolymers (TPS), in particular SBS, SEBS, SEPS, SEEPS and/or MBS, thermoplastic copolyamides (TPA), thermoplastic rubbers (TPR), glass fiber reinforced plastics (GFK), carbon fiber reinforced plastics (CFK), elastomers, natural latex, rubber, ethylene vinyl acetate (EVA), polyurethane (PU) and/or combinations thereof;
c) the material of the filling of the cut-outs is selected from the group comprising synthetic fiber fabrics, thermoplastics, thermoplastic elastomers on an olefin base (TPO), vulcanized thermoplastic elastomers on an olefin base (TPV), thermoplastic elastomers on a urethane base (TPU), thermoplastic copolyesters (TPC), styrene block copolymers (TPS), in particular SBS, SEBS, SEPS, SEEPS and/or MBS, thermoplastic copolyamides (TPA), thermoplastic rubbers (TPR), glass fiber reinforced plastics (GFK), carbon fiber reinforced plastics (CFK), elastomers, natural latex, rubber, ethylene vinyl acetate (EVA), polyurethane (PU) and/or combinations thereof.

12. A shoe sole in accordance with claim 1, wherein the shoe sole is selected from the group consisting of as a segmented outsole, segmented midsole, as a segmented insole and an inlay sole.

13. A shoe sole in accordance with claim 12, wherein the shoe sole is a segmented outsole, and the segmented outsole has a heel in the tarsal region and a damper is integrated in said heel, with the proviso that the Shore hardness of the damper is larger than the Shore hardness of the material of the outsole.

14. A shoe sole in accordance with claim 13, characterized in that the damper comprises ethylene vinyl acetate (EVA) and/or thermoplastic elastomers on a urethane base (TPU) and/or includes these materials and has a Shore hardness larger than 40.

15. A shoe sole in accordance with claim 14, wherein the shoe sole is selected from the group consisting of a segmented insole or a segmented midsole, and the segmented insole or the segmented midsole comprises a material starting from the toe region over the midfoot region up to the tarsal region or includes a material which has a changing Shore hardness, with the largest Shore hardness being present in the midfoot region.

16. A shoe sole in accordance with claim 15, wherein the shoe sole is selected from the group consisting of a segmented insole or a segmented midsole, and the segmented insole or the segmented midsole comprises ethylene vinyl acetate (EVA) and/or thermoplastic elastomers on a urethane base and/or includes these materials and the Shore hardness is larger than 40 in the midfoot region.

17. A shoe sole in accordance with claim 16, characterized in that the hardness changes continuously from the toe region over the midfoot region up to the tarsal region.

18. A shoe sole in accordance with claim 17 wherein the shoe sole a) is formed with two layers comprised of an outsole as well as an insole or inlay sole arranged above it; or b) is made in multiple layers comprised of an outsole, at least one midsole, and an insole and/or inlay sole arranged above the at least one midsole.

19. A shoe sole in accordance with claim 18, characterized in that at least two layers are formed as a shoe sole comprising at least one of the following of the respective lateral joint, the at least one medial joint and the at least one filled cut-out a) are arranged congruently or non-congruently; and/or b) have the same or different lengths and/or widths of the lateral and/or at least one medial joint or diameter of the at least one filled cut-out in the at least two layers.

20. A shoe sole in accordance with claim 1, wherein the material of at least one of the segmented structures has a graduated course of the Shore hardness.

21. A kinematic shoe sole having at least two layers, each layer comprising segmented structures and having a lateral joint as well as at least one medial joint which divide the sole into individual segments, wherein the lateral and/or the medial joint is formed as a groove in a partly or fully through-going manner through the layer, said groove being filled partly and/or fully with a flexible material, the lateral joint has at least one cut-out which is partly or fully filled with a material having an equal and/or a smaller Shore hardness, in comparison with the materials of the segments, the at least two segmented structures comprise material of different Shore hardness, wherein at least one lateral joint and at least one medial joint of the two layers are arranged non-congruently.

* * * * *